US009920572B2

(12) United States Patent
Moss et al.

(10) Patent No.: US 9,920,572 B2
(45) Date of Patent: Mar. 20, 2018

(54) STEPLADDERS AND RELATED METHODS

(71) Applicant: Wing Enterprises, Incorporated, Springville, UT (US)

(72) Inventors: N. Ryan Moss, Mapleton, UT (US); Gary M. Jonas, Springville, UT (US); Sean R. Peterson, Santaquin, UT (US); Ryan Crawford, Salem, UT (US)

(73) Assignee: Wing Enterprises, Incorporated, Springville, UT (US)

( * ) Notice: Subject to any disclaimer, the term of this patent is extended or adjusted under 35 U.S.C. 154(b) by 0 days.

(21) Appl. No.: 14/208,745

(22) Filed: Mar. 13, 2014

(65) Prior Publication Data

US 2014/0190768 A1 Jul. 10, 2014

Related U.S. Application Data

(63) Continuation of application No. 12/716,126, filed on Mar. 2, 2010, now Pat. No. 8,701,831.

(Continued)

(51) Int. Cl.
*E06C 1/383* (2006.01)
*E06C 1/387* (2006.01)

(Continued)

(52) U.S. Cl.
CPC ..... *E06C 1/383* (2013.01); *E06C 1/18* (2013.01); *E06C 1/387* (2013.01); *E06C 1/393* (2013.01); *E06C 7/084* (2013.01)

(58) Field of Classification Search
CPC ..... E06C 1/14; E06C 1/16; E06C 1/18; E06C 1/20; E06C 7/50; E06C 1/39; E06C 1/393; E06C 1/383; E06C 1/378; E06C 7/084

(Continued)

(56) References Cited

U.S. PATENT DOCUMENTS 235,827 A 12/1880 Sylvester
286,617 A 10/1883 Jones (Continued)

FOREIGN PATENT DOCUMENTS

CN 2182257 Y 11/1994
DE 75 14 377 9/1975

(Continued)

OTHER PUBLICATIONS

International Search Report dated May 25, 2010 for International Patent Application No. PCT/US2010/026075 (4 pages).

(Continued)

*Primary Examiner* — Daniel P Cahn
*Assistant Examiner* — Shiref M Mekhaeil
(74) *Attorney, Agent, or Firm* — Holland & Hart

(57) ABSTRACT

Stepladders and related methods of using and manufacturing stepladders are provided. In one embodiment, a stepladder is provided that comprises a top cap, a first assembly and a second assembly. The first assembly has a pair of spaced apart rails pivotally coupled with the top cap. The second assembly includes at least one rail pivotally coupled with the top cap. The first assembly and second assembly are configured to be displaced relative one another such that the stepladder is selectively positionable between a first, deployed state and a second, collapsed state. The first assembly, the second assembly and the top cap are cooperatively configured such that the at least one rail of the second assembly is at least partially nested within an envelope defined by the pair of spaced apart rails of the first assembly with the step ladder is in a collapsed state.

3 Claims, 11 Drawing Sheets

Related U.S. Application Data

(60) Provisional application No. 61/157,085, filed on Mar. 3, 2009, provisional application No. 61/175,731, filed on May 5, 2009.

(51) Int. Cl.
*E06C 1/393* (2006.01)
*E06C 7/08* (2006.01)
*E06C 1/18* (2006.01)

(58) Field of Classification Search
USPC ..... 182/177
See application file for complete search history.

(56) References Cited

U.S. PATENT DOCUMENTS 295,299 A 3/1884 George
475,935 A 5/1892 Crews
583,139 A 5/1897 Cliff
845,433 A * 2/1907 Peltier ..... E06C 1/393 182/124
848,513 A 3/1907 Trafton
930,333 A * 8/1909 Turner ..... E06C 1/52 182/163
961,357 A * 6/1910 Ketelsen ..... E06C 7/182 182/106
1,153,558 A * 9/1915 Matheny ..... E06C 1/005 182/156
1,198,739 A 9/1916 Marciniak et al.
1,224,599 A * 5/1917 Butcher ..... E06C 1/18 182/125
1,323,227 A 11/1919 Kirby
1,335,182 A 3/1920 Parkinson
1,427,293 A * 8/1922 Holliday ..... E06C 1/393 182/126
1,589,526 A 6/1926 Fuller
1,633,902 A * 6/1927 Olson ..... E06C 1/16 182/161
1,651,914 A 12/1927 Bertrand
1,671,801 A * 5/1928 White ..... E06C 1/393 182/126
1,973,774 A * 9/1934 Pflugradt ..... E06C 1/22 182/124
2,208,266 A * 7/1940 Meier ..... E06C 1/16 182/176
2,230,015 A 1/1941 Rich
2,339,593 A 1/1944 Weston
2,347,065 A * 4/1944 Rigby ..... E06C 1/20 182/177
2,364,048 A * 12/1944 Barkey ..... 182/172
2,368,915 A * 2/1945 Brandel ..... E06C 1/16 182/165
2,521,114 A * 9/1950 Campbell ..... 182/176
2,596,521 A * 5/1952 Bell ..... E06C 1/387 182/156
2,650,014 A 8/1953 Harrison
2,873,903 A * 2/1959 Osovski et al. ..... 182/26
2,919,762 A * 1/1960 Alford et al. ..... 182/22
2,960,181 A * 11/1960 Bufogle ..... E06C 1/20 182/176
3,446,311 A 5/1969 Alfie
3,637,046 A * 1/1972 Emmons ..... E06C 1/20 182/108
3,786,900 A * 1/1974 Olsen ..... 182/172
4,421,206 A * 12/1983 Kummerlin ..... E06C 1/20 182/1
5,722,507 A * 3/1998 Kain ..... 182/129
6,390,238 B1 * 5/2002 Gibson ..... E06C 1/387 182/129
6,450,290 B1 * 9/2002 Spak ..... E06C 1/387 182/156
D466,225 S * 11/2002 Rosko ..... D25/64
7,108,103 B2 * 9/2006 Meeker ..... E06C 7/087 182/165
D554,771 S * 11/2007 Skubic ..... D25/64
D564,675 S * 3/2008 Farber ..... D25/65
D565,745 S * 4/2008 Meyers ..... D25/65
7,837,010 B2 * 11/2010 Astor ..... E06C 7/085 182/217
7,849,967 B2 * 12/2010 Gibson ..... E06C 1/393 182/165
7,931,123 B2 * 4/2011 Moldthan ..... E06C 1/387 182/129
8,011,473 B1 * 9/2011 Gregersen ..... E06C 1/16 182/101
8,186,481 B2 5/2012 Moss et al.
2005/0274575 A1 * 12/2005 Gibson ..... E06C 7/14 182/129
2005/0284701 A1 * 12/2005 Gibson ..... A47C 12/00 182/165
2006/0006024 A1 * 1/2006 Till ..... E06C 7/14 182/129
2007/0029138 A1 * 2/2007 Howe ..... E06C 1/393 182/107
2007/0056797 A1 * 3/2007 Wang ..... B62B 1/12 182/21
2009/0229918 A1 * 9/2009 Moss ..... E06C 1/18 182/129
2010/0224445 A1 * 9/2010 Moss ..... E06C 1/387 182/129
2011/0024232 A1 * 2/2011 Leng ..... E06C 1/18 182/116
2014/0224585 A1 * 8/2014 Russell ..... E06C 1/18 182/116
2015/0267469 A1 * 9/2015 Markusen ..... E06C 1/16 182/21
2016/0076304 A1 * 3/2016 Smith ..... E06C 7/003 182/18

FOREIGN PATENT DOCUMENTS

EP 0 065 492 A2 11/1982
EP 1 865 143 A2 12/2007
GB 615 065 12/1948
JP 59 160799 9/1984

OTHER PUBLICATIONS

English Translation of the Notification of the First Office Action and Search Report for CN Application No. 201080010704.7, dated Jul. 23, 2013 (7 pages).
English Abstract and Machine Translation of CN 2182257. Nov. 9, 1994.
English Translation of DE 75 14 377. Sep. 18, 1975.
English Translation of EP 0 065 492 A2. Nov. 24, 1982.
English Translation of JP 59 160799. Sep. 11, 1984.

* cited by examiner

STEPLADDERS AND RELATED METHODS

CROSS-REFERENCE TO RELATED APPLICATIONS

This application is a continuation of U.S. patent application Ser. No. 12/716,126, filed Mar. 2, 2010, now U.S. Pat. No. 8,701,831 entitled STEPLADDERS AND RELATED METHODS, which claims the benefit of U.S. Provisional Patent Application No. 61/157,085 filed Mar. 3, 2009, entitled STEPLADDERS AND RELATED METHODS, and U.S. Provisional Patent Application No. 61/175,731 filed May 5, 2009, entitled LADDERS, LADDER COMPONENTS, LADDER ACCESSORIES, LADDERS SYSTEMS AND RELATED METHODS, the disclosures of which are incorporated by reference herein in their entireties.

TECHNICAL FIELD

The present invention relates generally to ladders and, more particularly, to configurations of stepladders and methods of making and using stepladders.

BACKGROUND

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders. So-called combination ladders may incorporate, in a single ladder, many of the benefits of multiple ladder designs.

Ladders such as stepladders are highly utilized by various tradesman as well as homeowners. Such ladders are "self-supporting" in that they do not require the upper end of the ladder to be positioned against a supporting structure, such as a wall or the edge of a roof. Rather, stepladders include multiple feet (typically either three or four) that are spaced from one another and provide a stable base or foundational structure to support the ladder and a user when placed on, for example, a floor or the ground. This enables a user of the ladder to gain access to elevated areas even though the accessed area may be, for example, in the middle of a room, away from walls or other potential supporting structures that are conventionally required when using a straight ladder or an extension ladder.

For these reasons and others, step ladders are one of the more popular forms of ladders and comprise a large segment of the ladder market. However, there are always areas of potential improvement. For example, conventional configurations of stepladders are often considered bulky. The bulky size of the ladder, when they are in a collapsed or storable state, can make it difficult to carry the ladder and may cause it to take up more space than desired when being stored or transported. Moreover, the volume occupied by a ladder has significant impact on shipping costs and on the amount of ladders that may be stored, displayed, or both, within a retail establishment or a distributor's warehouse.

In other words, when in a collapsed state, the volume occupied by a stepladder is largely air because the stepladder is constructed generally as a frame-like structure. The structure conventionally includes a first assembly including a set of spaced-apart side rails coupled to a plurality of steps or rungs. Another assembly includes set of spaced-apart side rails and is conventionally positioned adjacent the first assembly, when in a collapsed or storable state, to define a volume generally having a height equal to that of the taller of the first assembly and the second assembly, a width equally to that of the wider of the first assembly and the second assembly, and a depth that is equal to a sum of the depth of the first assembly and the depth of the second assembly.

Thus, it would be advantageous to provide stepladders that define a smaller volume when in a collapsed or stored state while maintaining similar strength and stability characteristics of a ladder having a similar size and capacity when in a deployed or useable state. It would also be advantageous to provide methods related to manufacturing and using stepladders that result in reduced bulk and volume of such ladders while in a collapsed state and also maintaining the general usability of the ladder.

BRIEF SUMMARY OF THE INVENTION

The present invention relates to ladders and, more particularly, various configurations of stepladders, as well as to methods relating to the use and manufacture of stepladders.

In accordance with one embodiment, a stepladder is provided that comprises a top cap, a first assembly and a second assembly. The first assembly has a pair of spaced apart rails pivotally coupled with the top cap. The second assembly includes at least one rail pivotally coupled with the top cap. The first assembly and second assembly are configured to be displaced relative one another such that the stepladder is selectively positionable between a first, deployed state and a second, collapsed state. The first assembly, the second assembly and the top cap are cooperatively configured such that the at least one rail of the second assembly is at least partially nested within an envelope defined by the pair of spaced apart rails of the first assembly when the step ladder is in a collapsed state.

In one embodiment, the first assembly of the stepladder may further include a plurality of rungs coupled between the pair of spaced apart rails. Additionally, the at least one rail of the second assembly comprises a pair of spaced apart rails. In one embodiment, the stepladder may further comprise: a pair of spaced apart spreaders with each spreader being coupled between the first assembly and the second assembly and having a hinge; and a pair of struts with each strut being coupled between an associated spreader and a rail of the pair of spaced apart rails of the second assembly. In one particular embodiment, each strut of the pair of struts maintains a substantially parallel relationship to an associated rail of the pair of spaced apart rails of the first assembly.

In accordance with another embodiment of the present invention, a stepladder is provided that includes a first assembly having a pair of spaced apart rails, the rails exhibiting a first depth between an exterior edge and an interior edge thereof. The stepladder further includes a second assembly having a pair of spaced apart rails, the rails exhibiting a second depth between an interior edge and an exterior edge thereof. The second assembly is pivotally positionable relative to the first assembly between a first, deployed state and a second, collapsed state. A total depth of the stepladder, when in the collapsed state, is less than the sum of the first depth and the second depth.

In accordance with another embodiment of the present invention, a stepladder includes a first assembly including a pair of spaced apart rails defining a first volume. The stepladder further includes a second assembly including a pair of spaced apart rails defining a second volume. The second assembly is pivotally positionable relative to the first assembly between a first, deployed state and a second, collapsed state. A total volume of the stepladder, when in the collapsed state, is less than a sum of the first volume and the second volume.

In accordance with yet another embodiment of the present invention, a stepladder includes a first assembly including a pair of spaced apart rails defining a first volume and a second assembly including a pair of spaced apart rails defining a second volume. The second assembly is pivotally positionable relative to the first assembly between a first, deployed state and a second, collapsed state, wherein the first volume and the second volume at least partially merge when the stepladder is in the collapsed state.

In accordance with another embodiment of the present invention, a method is provided for storing a ladder having a first assembly including a pair of spaced apart rails defining a first volume and a second assembly including a pair of spaced apart rails defining a second volume. The method includes collapsing the ladder from a first deployed state to a second, collapsed state such that the ladder, when in the second collapsed state, defines a total volume that is less than the sum of the first volume and the second volume.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
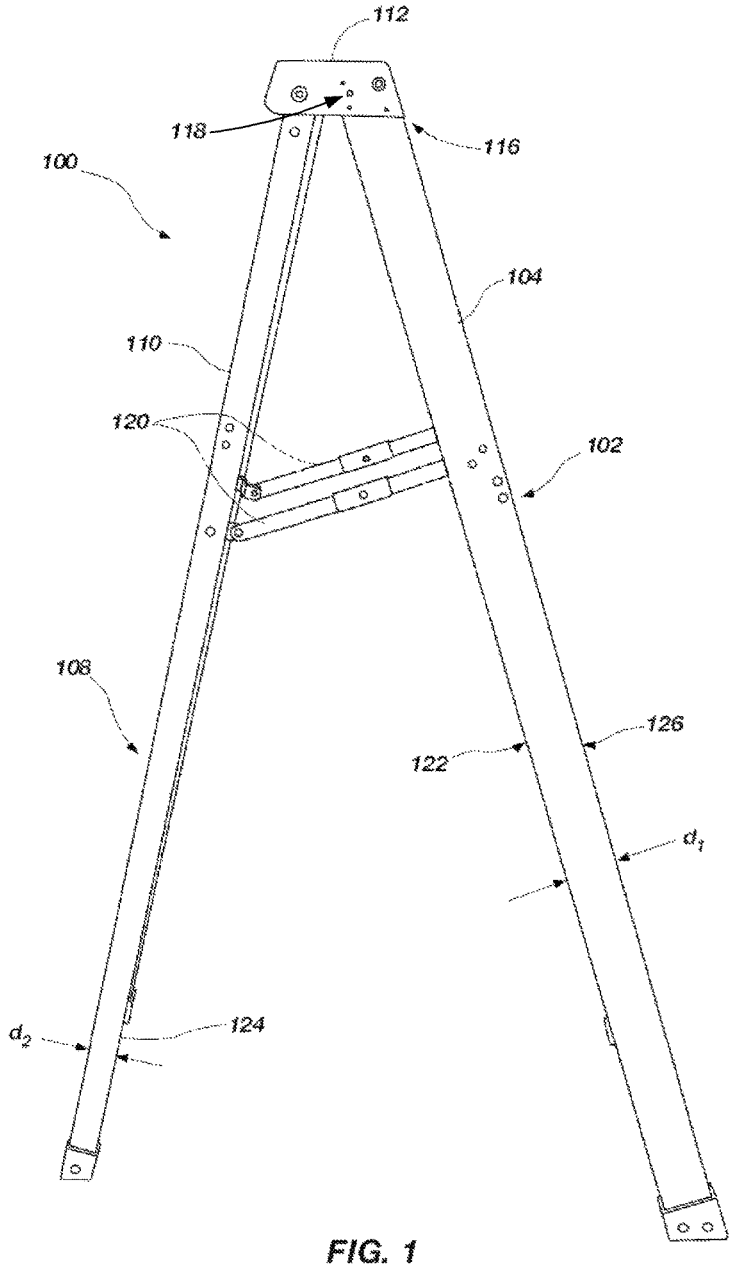
FIG. 1 is a side view of a stepladder according to an embodiment of the present invention.

Referring generally to FIGS. 1 through 7, a stepladder 100 is shown in accordance with an embodiment of the present invention. The stepladder 100 includes a first assembly 102 having a pair of spaced apart rails 104 and a plurality of rungs 106 extending between, and coupled to, the rails 104. The rungs 106 are substantially evenly spaced, parallel to one another, and are configured to be substantially level when the stepladder 100 is in an orientation for intended use, so that they may be used as "steps" for a user to ascend the stepladder 100 as will be appreciated by those of ordinary skill in the art.

The stepladder 100 also includes a second assembly 108 having a pair of spaced apart rails 110. The second assembly 108 need not include a plurality of rungs between the spaced apart rails 110. Rather, bracing or other structural components may be used to provide a desired level of support and strength to the spaced apart rails 110. However, in some embodiments, the second assembly 108 may include rungs configured generally similar to those associated with the first assembly 102. The second assembly 108, thus, may be used to help support the stepladder 100 when in an intended operational state, such as depicted generally in FIG. 1.

The first and second assemblies 102 and 108 may be formed of a variety of materials and using a variety of manufacturing techniques. For example, in one embodiment, the rails 104 and 110 may be formed of a composite material, such as fiberglass, while the rungs and other structural components may be formed of aluminum or an aluminum alloy. In other embodiments, the assemblies 102 and 108 (and their various components) may be formed of other materials including other composites, plastics, polymers, metals and metal alloys.

A top cap 112 is coupled to a portion of the first assembly 102 and a portion of the second assembly. For example, the top cap 112 may be pivotally coupled to an upper end 114 of each rail 104 of the first assembly 102 along a common axis, and it may also be pivotally coupled to an upper end 116 of each rail 110 of the second assembly 108 along another common axis. It is noted that used of the term "upper end" merely refers to a relative position of the described components when the stepladder 100 is in an intended use orientation. In one embodiment, the top cap 112 may simply be a component configured to facilitate relative coupling of the first and second assemblies 102 and 108. In other embodiments, the top cap may include features that enable it to be used as a tray or a tool holder. Thus, the top cap 112 may be used to organize a user's tools and resources while working on the stepladder 100. For example, such a top cap is described in U.S. patent application Ser. No. 12/399,815 entitled LADDERS, LADDER COMPONENTS AND RELATED METHODS and filed Mar. 6, 2009, the disclosure of which is incorporated by reference herein in its entirety. It is noted that, for safety purposes, the top cap is not conventionally configured as a "rung" or a "step."

As with other components of the stepladder 100, the top cap 112 may be formed from a variety of materials. In one embodiment, the top cap 112 may be formed from a plastic material that is molded into a desired size and shape.

A locking mechanism 118 may be used to prevent the top cap 112 from pivoting relative to either the first assembly 102 or the second assembly 108. For example, the locking mechanism 118 may include a pair of retractable pin members with each pin extending through a hole in an associated rail (e.g., rail 110) and an associated hole in the top cap 112 to prevent rotation of the top cap 112 relative to the rail (e.g., rail 110). In such an example, the pins may be biased to remain engaged with the rails and top cap 112. An actuating mechanism (e.g. a pull cord 119 or other structure or mechanism) may then be used to selectively retract the pins and cause them to disengage the top cap 112, the rails (e.g., rails 110) or both.

A pair of hinged braces, referred to herein as spreaders 120, are used to maintain a desired angle between the first and second assemblies 102 and 108 when the stepladder 100 is in a deployed or useable state. The hinged nature of such spreaders 120 helps to enable the first and second assemblies 102 and 108 to collapse into a stored state and then help lock the assemblies 102 and 108 in position relative to one another when in a deployed or useable state.

Figure 2:
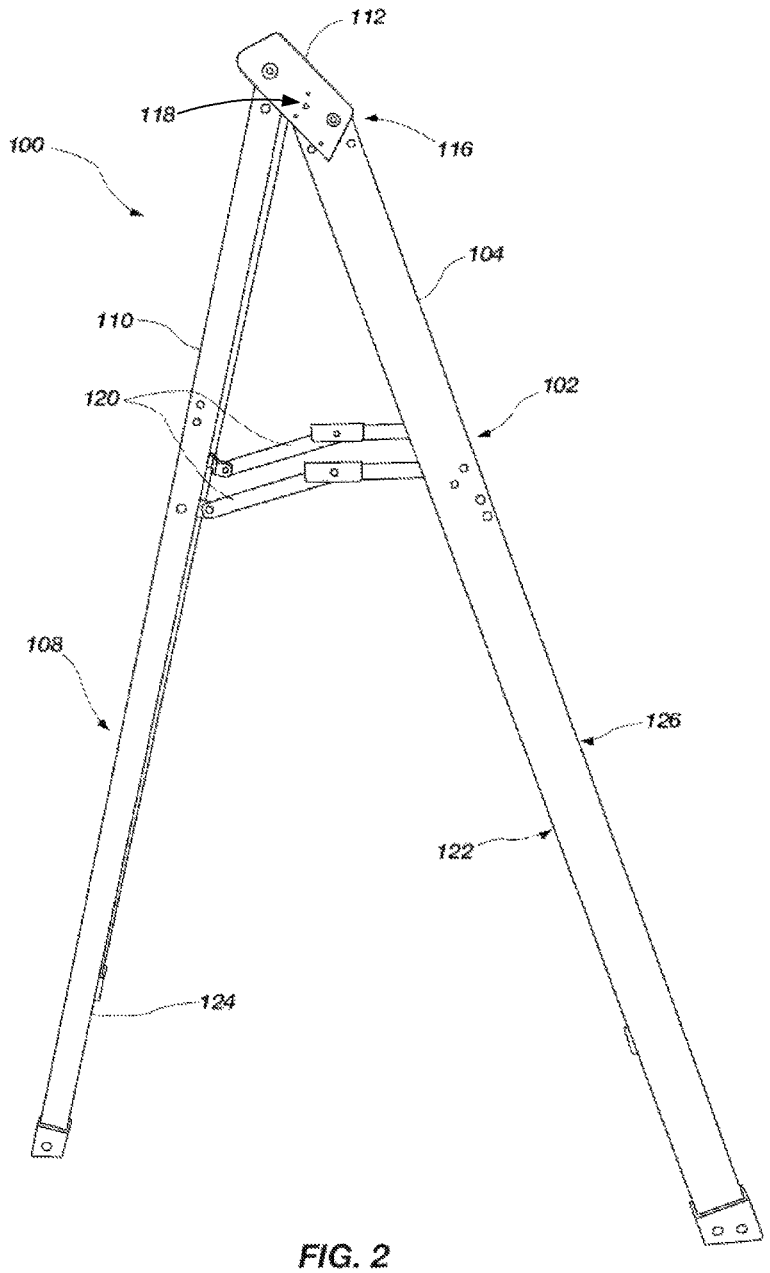
FIG. 2 is a side view of the stepladder shown in FIG. 1 while in a partially collapsed state.

Referring more specifically to FIGS. 1 through 4, the stepladder 100 is shown in various states. FIG. 1 shows the stepladder 100 in a state of intended use wherein a user may climb the stepladder 100 by ascending the rungs 104 of the first assembly 102. FIG. 2 shows the ladder in a partially collapsed state wherein the spreaders 120 are being folded and the first and second assemblies 102 and 108 are being pivoted towards one another. It is noted that the top cap 112 is pivoting relative to both the first and second assemblies 102 and 108 when the assemblies 102 and 108 are being pivoted towards one another.

Figure 3:
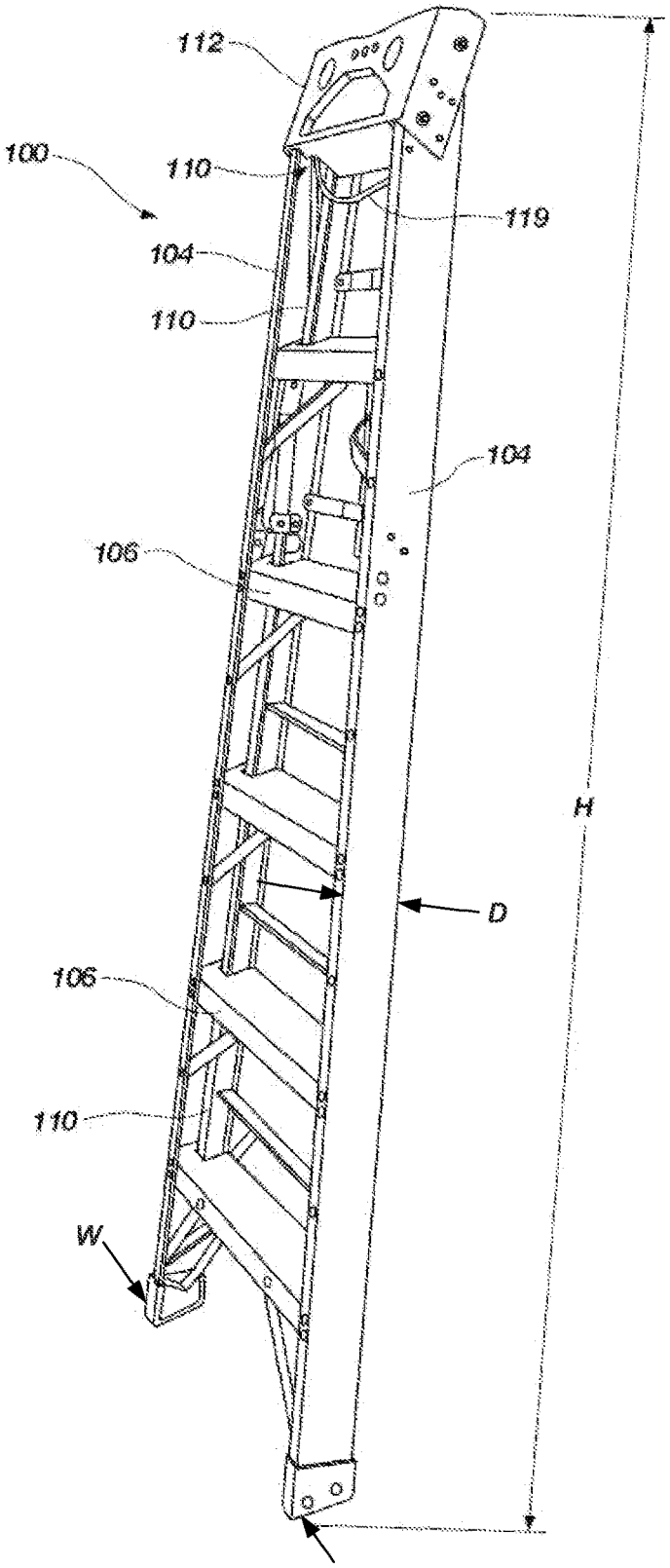
FIG. 3 is a perspective view of the stepladder shown in FIG. 1 while in a collapsed state.
Figure 4:
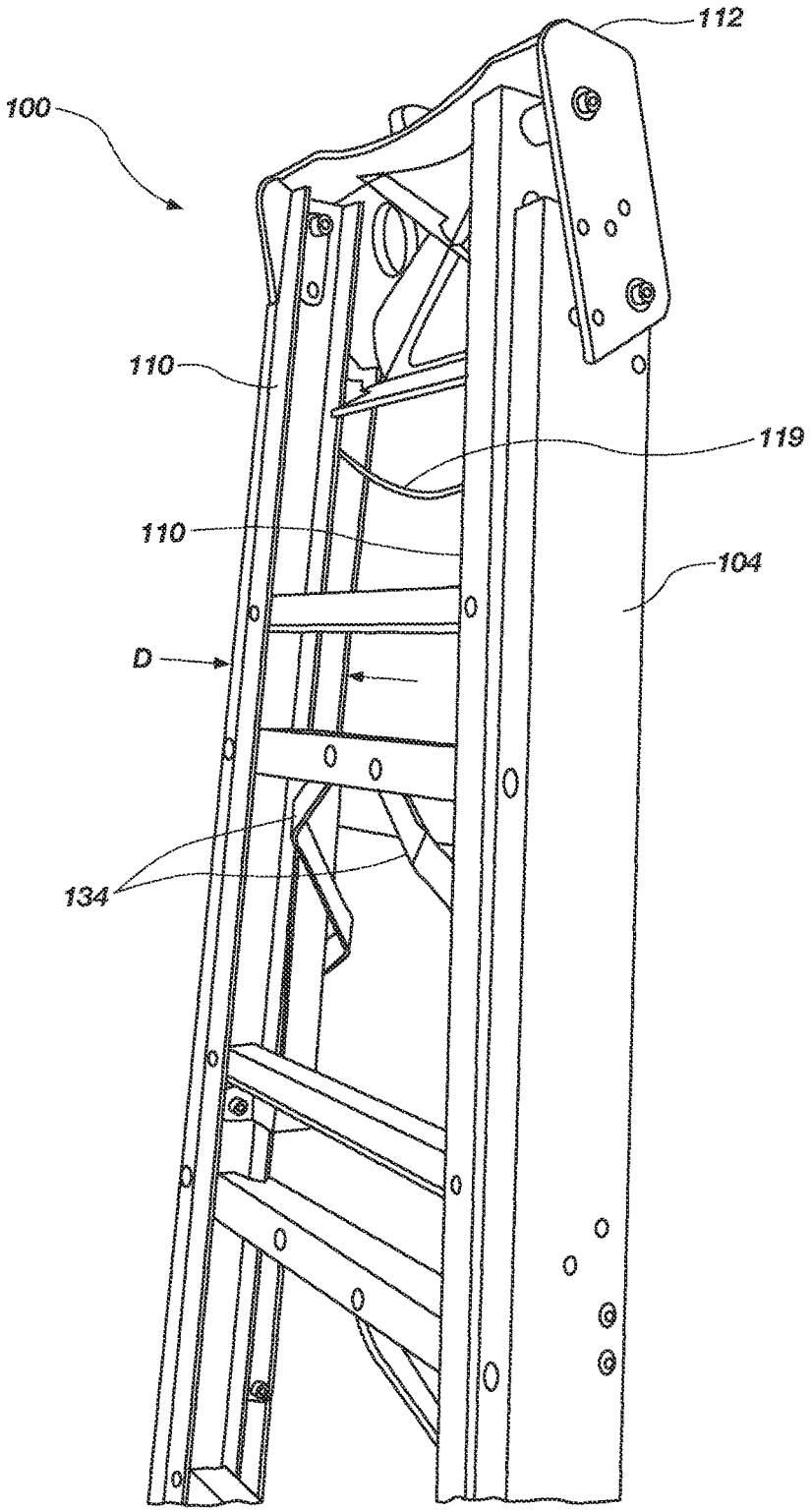
FIG. 4 is another perspective view of the stepladder shown in FIG. 1 while in a collapsed state.
Figure 5:
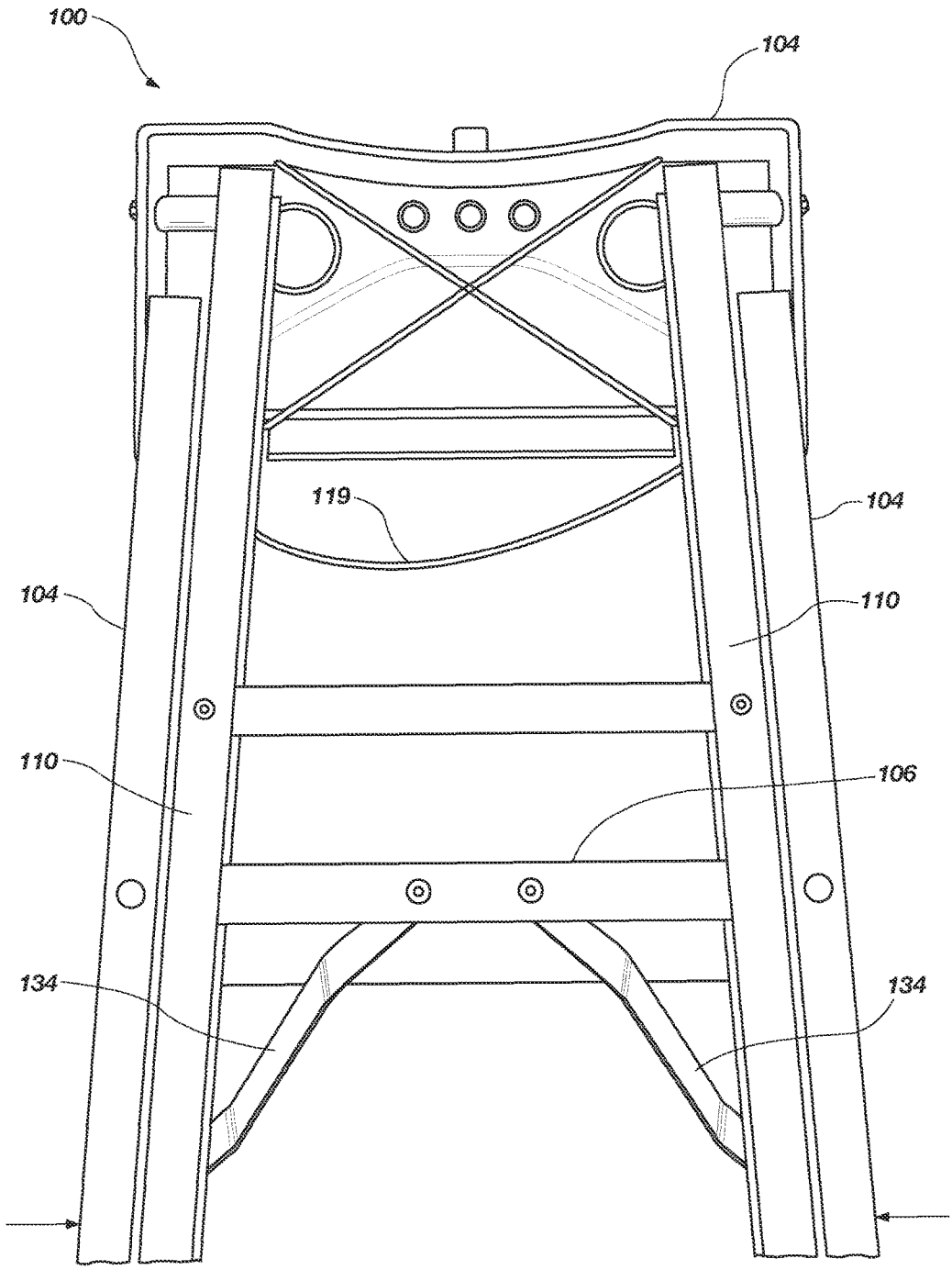
FIG. 5 is a back or rear view of a portion of the stepladder shown in FIG. 1 while in a collapsed state.
Figure 6:
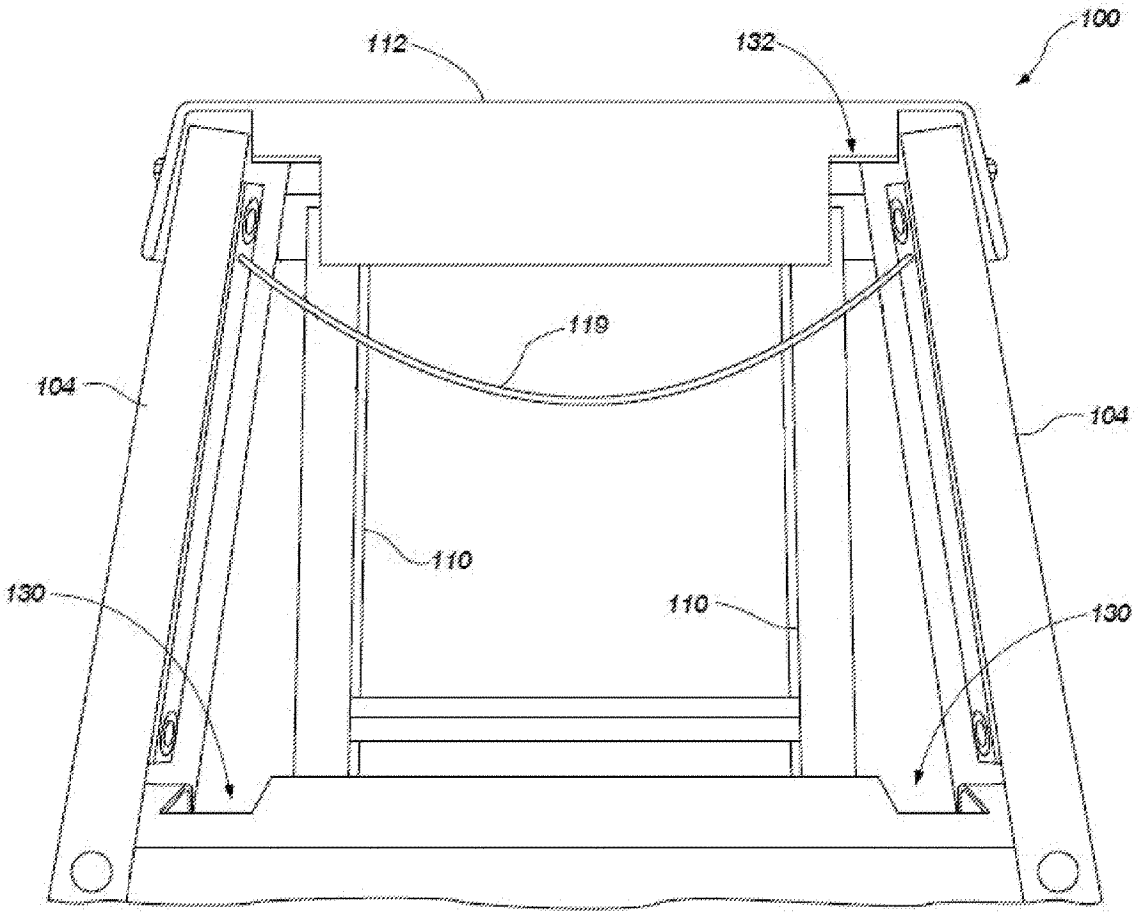
FIG. 6 is front view of a portion of the stepladder shown in FIG. 1 while in a deployed stated.
Figure 7:
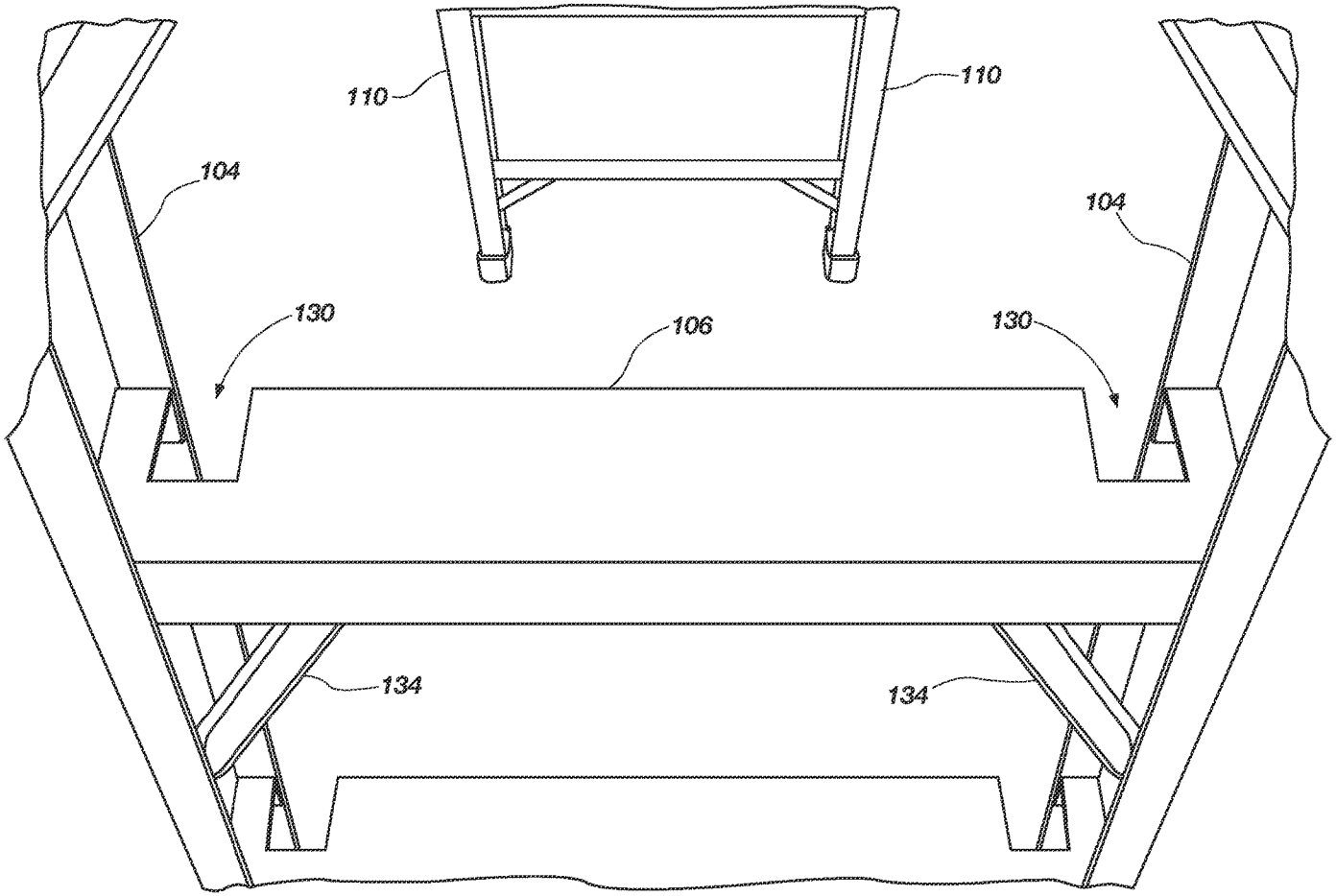
FIG. 7 is a front perspective view of portions of the stepladder shown in FIG. 1 while in a deployed state.

FIGS. 3 and 4 show the stepladder 100 in a fully collapsed, or "storable" state. As previously noted, as the stepladder 100 transitions from the deployed or useable state (FIG. 1) to the collapsed or storable state (FIGS. 3 and 4), the top cap 112 (with the locking mechanism 116 having been disengaged) pivots relative to both the first assembly 102 and the second assembly 108. This is in contrast to conventional stepladders wherein the top cap is fixed to one of either the first or second assembly 102 or 108.

Additionally, when in a collapsed state, the second assembly 108 becomes nested within the first assembly 106. In other words, the interior surface or edge 122 of the rails 104 of the first assembly 102 do not simply abut, or become placed immediately adjacent, the interior surface or edge 124 of the rails 110 of the second assembly 108. Rather, the interior edge 124 of the rails 110 of the second assembly 108 are actually displaced beyond the interior edge 122 of the rails of the first assembly 102 and towards the exterior surface or edge 126 (also referred to as the face edge) of the rails 104 of the first assembly 102.

Stated yet another way, an envelope or volume of space is defined by the rails 104 of the first assembly 102 and the rotated top cap 112. When the stepladder 100 is in a collapsed state, the second assembly 108 becomes at least partially disposed within the volume or envelope defined by the first assembly 102 or the volume or envelope defined by the first assembly 102 and the rotated top cap 112. In one embodiment, such as more specifically shown in FIGS. 3 and 4, the second assembly 108 becomes completely (or substantially completely) disposed within the envelope or volume defined by the first assembly 108 and the rotated top cap 112 when the stepladder 100 is in a collapsed state.

Such a configuration is in contrast to conventional stepladders wherein interior edges of rails in one assembly abut interior edges of rails of the other assembly. In the stepladder 100 of the presently described embodiment, the depth D of the stepladder 100, when in a collapsed state, is less than the sum of the depth $d_1$ of the rails 104 of the first assembly 102 and the depth $d_2$ of the rails 110 of the second assembly 108 (i.e., $D<d_1+d_2$). In some embodiments, the depth D of the stepladder 100 when in the collapsed state is substantially equal to the depth $d_1$ of the rails 104 of the first assembly 102 (i.e., $D\approx d_1$). In contrast, the overall depth of conventional stepladders when in a collapsed state is equal to or greater than the sum of the individual depths of the rails (i.e., $D\geq d_1+d_2$).

The reduction in depth D of the stepladder 100 when in a collapsed state provides significant advantages over conventional prior art ladders. For example, the reduction in depth D results in a corresponding reduction in volume of the stepladder 100 (the volume V being calculated as the depth D multiplied by the height H, and further multiplied by the width W—i.e., $V=D\times H\times W$—when the stepladder is in a collapsed state). A reduced volume V provides a significant reduction in the cost to ship or transport such ladders to distributors, retailers or end users. Additionally, the reduced volume of the collapsed stepladder 100 enables distributors and retailers to store a greater number of ladders in a given volume of storage or for a given amount of floor space Likewise, end users are able to store the stepladders in a smaller volume of space, whether that be in their garage, in a closet, on or in a vehicle, in a warehouse or the like. Stepladders with a reduced depth D are also easier to transport by and end user, whether they are being carried by hand, being transported by vehicle on a roof rack, within a car or truck or by some other mode.

Still referring to FIGS. 1 through 7, various features of the presently described embodiment are shown which may be used to help enable the stepladder to achieve the reduced depth D when in a collapsed state. For example, the rungs 106 of the first assembly 102 may be configured with cut-outs or notches 130 sized and configured to receive the rails 110 (or at least a portion of the rails 110) of the second assembly so that the rails 110 of the second assembly 108 may become nested within the rails 104 (or within the envelope) of the first assembly 102. Likewise, cut-outs or notches 132 may be formed in a portion top cap 112 so that the top cap 112 may rotate relative to the rails 104 of the first assembly 102 without interference.

The stepladder 100 may also include a plurality of braces 134 or other support structures coupled, for example, to the side rails 104 of the first assembly 102 and to the back or interior edges of the rungs 106. The braces 134 may be coupled to the rungs 106 adjacent the notches 130 such that the notches 130 are positioned between the rails 104 and the location of coupling between the braces 134 and the rungs 106. The use of braces 134 provides additional support and rigidity for the rungs 106 in light of the material removed from the rungs 106 to form the notches 130.

As previously noted, a locking mechanism 118 may be used to lock the top cap 112 relative to the first assembly 102, the second assembly 108 or both when the stepladder 100 is in a deployed condition similar to the fixed nature of a top cap (relative to at least one assembly) in a conventional prior art step ladder. However, the selective disengagement of the locking mechanism 118 from the top cap 112 enables the pivoting of the top cap 112 relative to each of the first assembly 102 and the second assembly 108 so that the first and second assemblies may be collapsed relative to one another in the manner described above.

Referring now to FIGS. 8 through 11, another embodiment of a stepladder 200 is shown. The stepladder 200 includes a first assembly 202 having a pair of spaced apart rails 204 and a plurality of rungs 206 extending between and coupled to the rails 204. The rungs 206 are substantially evenly spaced, parallel to one another, and are configured to be substantially level when the stepladder 200 is in an orientation for intended use.

The stepladder 200 also includes a second assembly 208 having a pair of spaced apart rails 210. The second assembly 208 need not include a plurality of rungs between the spaced apart rails 210. Rather, bracing or other structural components may be used to provide a desired level of support to the spaced apart rails 210. However, in some embodiments, the second assembly 208 may include rungs configured, for example, generally similar to those associated with the first assembly 202. The second assembly 208, thus, may be used to help support the stepladder 200 when in an intended operational state, such as depicted generally in FIG. 8.

A top cap 212 is coupled to a portion of the first assembly 202 and a portion of the second assembly 208. For example, the top cap 212 may be pivotally coupled to an upper end 214 of each rail 204 of the first assembly 202, and it may also be pivotally coupled to an upper end 216 of each rail 210 of the second assembly 208. In one embodiment, the top cap 212 may simply be a component configured to facilitate relative coupling of the first and second assemblies 202 and 208. In other embodiments, the top cap may include features that enable it to be used as a tray or a tool holder as previously described.

The first and second assemblies 202 and 208 may be formed of a variety of materials and using a variety of manufacturing techniques such as has been described hereinabove with respect to the stepladder described in associated with FIGS. 1 through 7 Likewise, the top cap 212 may be formed from a variety of materials as previously described.

A pair of hinged braces, referred to herein as spreaders 220, are used to maintain a desired angle between the first and second assemblies 202 and 208 when the stepladder 200 is in a deployed or useable state. The hinged nature of such spreaders 220 provides support to the stepladder 200 when in a deployed state, but also helps to enable the first and second assemblies 202 and 208 to collapse into a stored state. A strut member 222 has one end pivotally coupled to the spreader 220 at a location between the hinge component 223 and the first assembly 202. A second end of the strut member 222 is pivotally coupled to the rails 210 of the second assembly 208 or the top cap 212 at a location generally adjacent to the pivotal coupling between the second assembly 208 and the top cap 212. In another embodiment, the second end of the strut member 222 may be coupled with the same pivot 225 that couples the second assembly 208 and the top cap 212.

Figure 8:
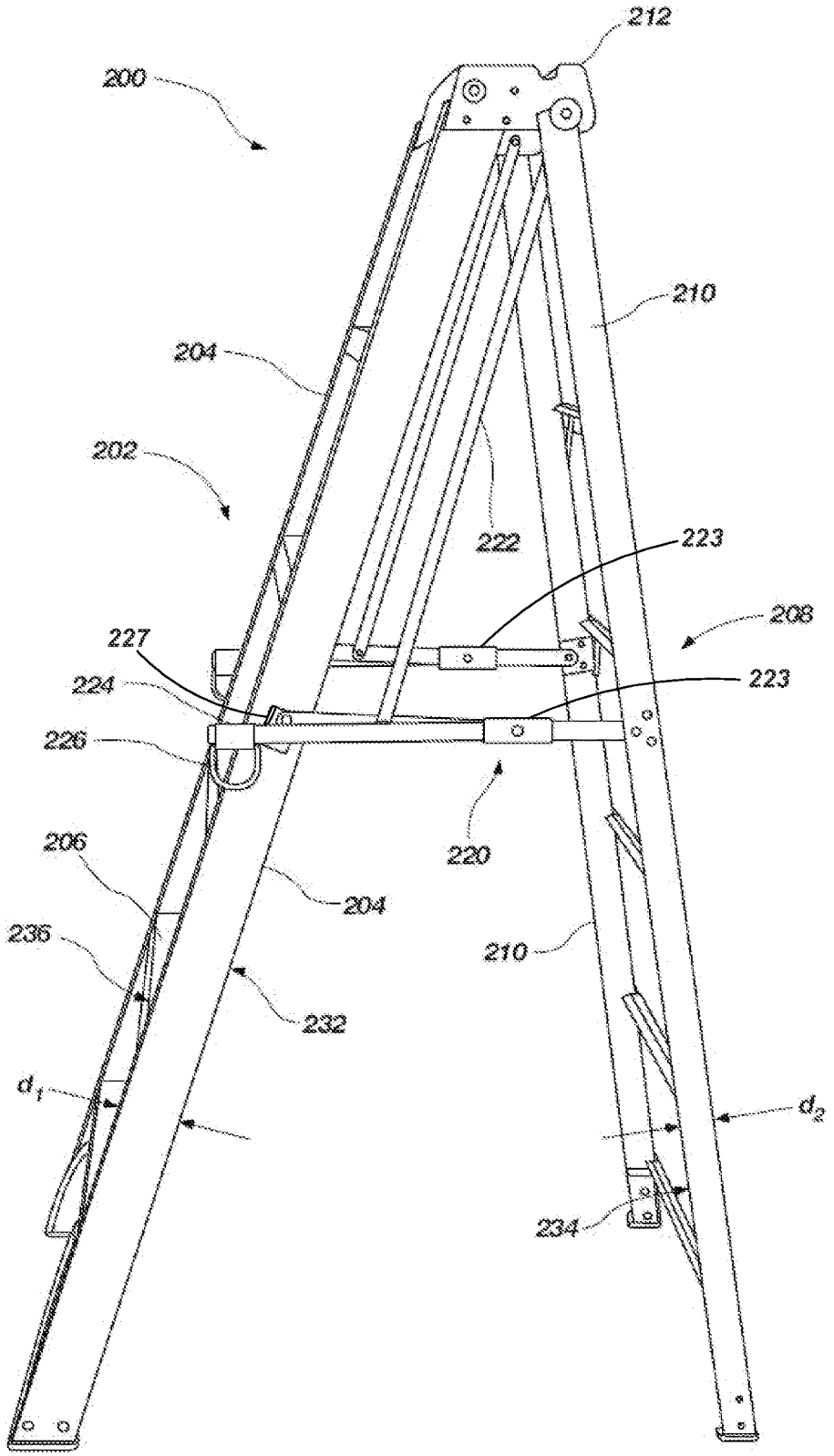
FIG. 8 is a side view of a stepladder in accordance with another embodiment of the present invention.

Another strut member 224 may be coupled to the spreader 220 such that it extends from the portion of the spreader 220 between the hinge of the spreader and the second assembly 208 and towards the first assembly 202 when the stepladder 200 is in a deployed state as seen in FIG. 8. Handles or loops 226 may be coupled to the end of the strut members 224 and may be used to assist in transitioning the stepladder 200 between a collapsed state and a deployed state or vice versa. A lip or shoulder 227 may be formed for example, on the rails 204 or some other component associated with the first assembly 202 to help "lock" the strut member 224 in a deployed position (i.e., as shown in FIG. 8). When collapsing the ladder 200, the strut members 224 may be laterally displaced (away from the rail 204) to pass by the lip or shoulder 227 so that the spreader 220 may fold and the two assemblies 202 and 208 collapse as described below.

Figure 9:
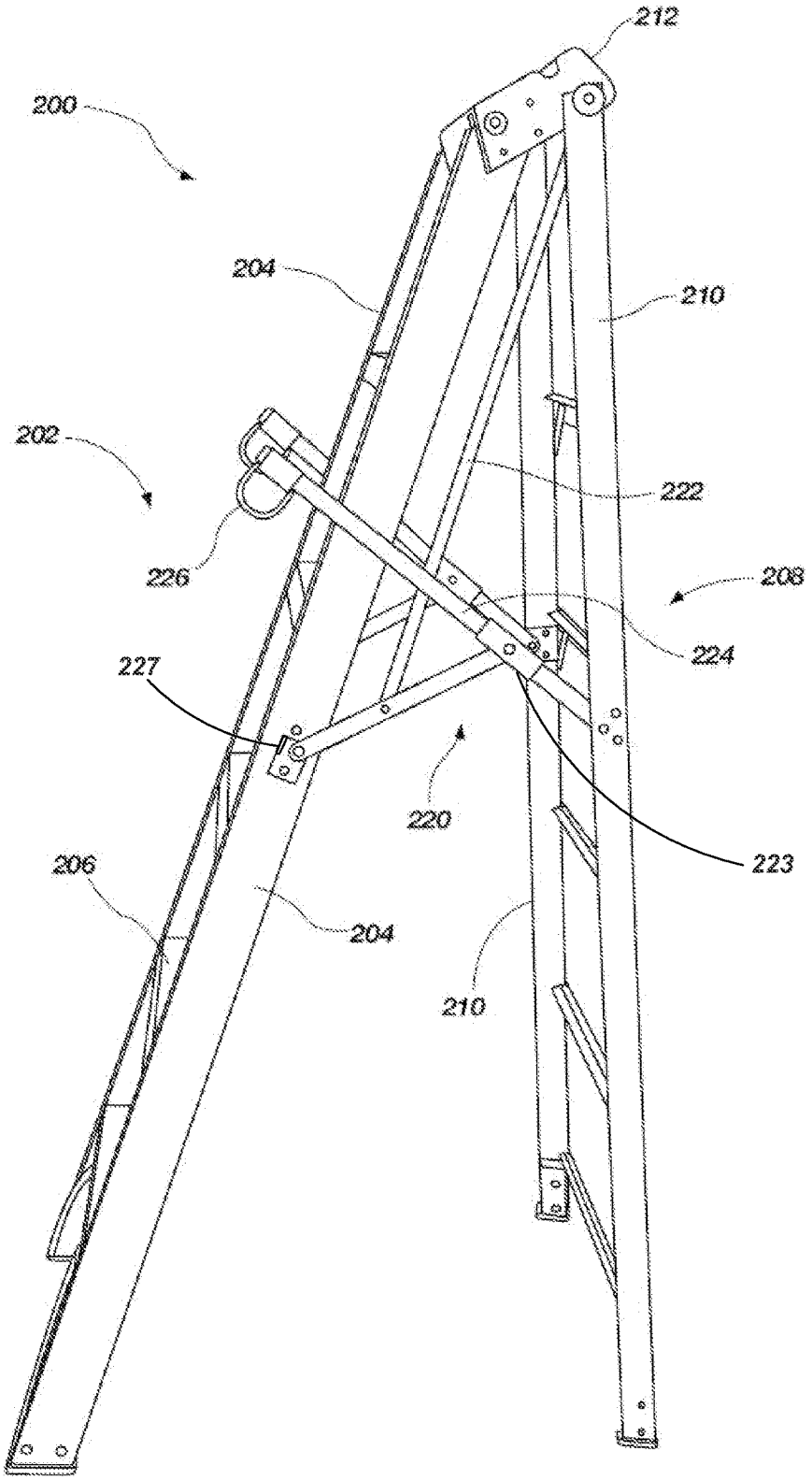
FIG. 9 is a side view of the stepladder shown in FIG. 8 while in a partially collapsed state.
Figure 10:
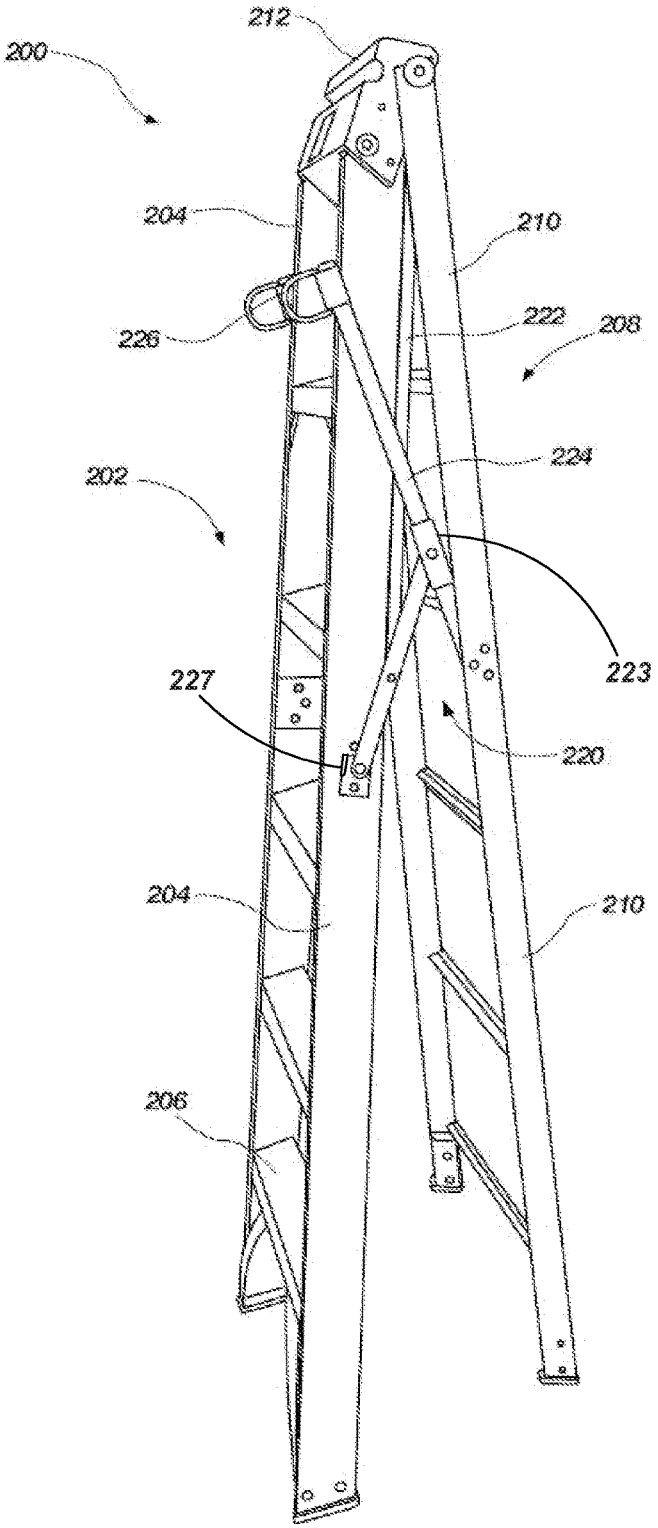
FIG. 10 is a side view of the stepladder shown in FIG. 8 while in a further collapsed state as compared to that of FIG. 9.

As previously noted, FIG. 8 shows the stepladder 100 in a state of intended use wherein a user may climb the stepladder 200 by ascending the rungs 206 of the first assembly 202. FIG. 9 shows the stepladder 200 in a partially collapsed state wherein the spreaders 220 are being folded and the first and second assemblies 202 and 208 are being pivoted towards one another. FIG. 10 shows the stepladder 200 in a further collapsed state (as compared to that shown in FIG. 9) but not a fully collapsed state. In comparing FIGS. 8, 9 and 10, it becomes apparent that, as the spreaders 220 are folded, the strut members 222 between the spreader 220 and the second assembly 208 help to push the second assembly 208 up relative to the first assembly 202. In other words, the strut members 224 help to rotate the top cap 212 relative to the first assembly 202 during the collapsing or folding process. It is also noted that, in the particular embodiment shown in FIGS. 8 through 11, the strut members 222 may maintain a generally parallel relationship with the rails 204 of the first assembly 202, although the space between them becomes reduced, during the collapsing or folding process. Additionally, the strut members 224 acting as an extension of the spreader 220 rotate upwards and back towards the second assembly 208 during the collapsing or folding process.

It is also noted that the strut members 222, in conjunction with the spreader 220, effectively lock the top cap 212 in place when the ladder 200 is in a deployed state (i.e., FIG. 8). This prevents the first assembly 202 and second assembly 208 from rotating relative to the top cap 212 such that the ladder maintains stability when being utilized.

Figure 11:
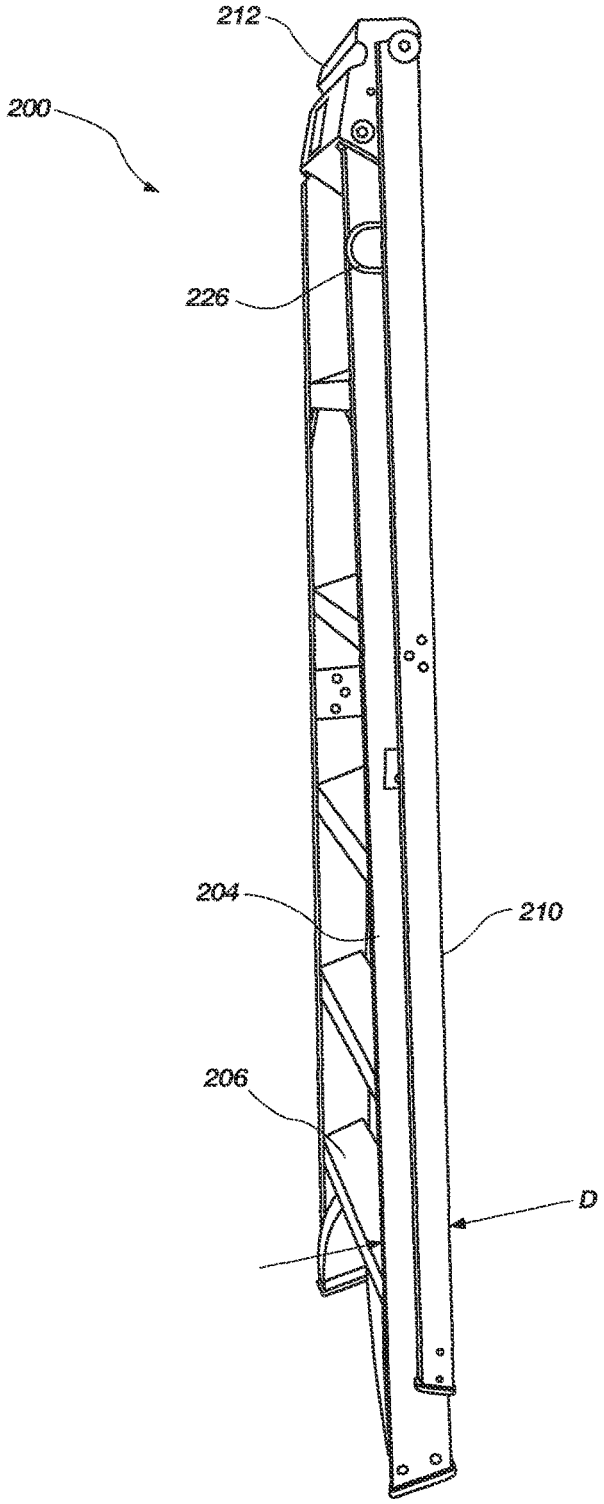
FIG. 11 is a perspective view of the stepladder shown in FIG. 8 while in a collapsed state.

FIGS. 11 shows the stepladder 200 in a fully collapsed state. As the stepladder 200 transitions from the deployed or useable state (FIG. 8) to the collapsed or storable state (FIG. 11), the top cap 212 pivots relative to both the first assembly 202 and the second assembly 208. Additionally, when in a collapsed state, the first assembly 202 becomes partially nested within the second assembly 208 (the rails 210 of the second assembly 208 being positioned laterally outward of the rails 204 of the first assembly 202). In other words, the interior surface or edge 232 of the rails 204 of the first assembly 202 do not simply abut, or become placed immediately adjacent, the interior surface or edge 234 of the rails 210 of the second assembly 208 when in the collapsed state. Rather, the interior edge 234 of the rails 210 of the second assembly 208 are actually displaced beyond the interior edge 232 of the rails of the first assembly 202 and towards the exterior surface or edge 236 (also referred to as the face edge) of the rails 204 of the first assembly 202.

As with the embodiment described with respect to FIGS. 1 through 7, the overall depth D of the stepladder 200 when in a collapsed state is actually less than the sum of the depth $d_1$ of the rails 204 of the first assembly and the depth $d_2$ of the rails 210 of the second assembly 208. Thus, as with the previously described embodiment, an envelope or volume of space defined by the rails 204 of the first assembly 202 and an envelope of volume of spaced defined by the rails 210 of the second assembly 208 overlap or at least partially merge together to define a smaller overall volume when the stepladder 200 is in the collapsed state.

While the result is similar to that of the embodiment described with respect to FIGS. 1-7, the presently described stepladder 200 accomplishes this in a slightly different manner. Rather than the second assembly 208 being nested within, or being positioned within the envelope of, the first assembly 202, the rails 210 of the second assembly 208 are slightly wider that the rails 204 of the first assembly 202 such that the first assembly 202 becomes at least partially nested or partially disposed within the envelope of the second assembly 208. However, as already noted, when in a collapsed state, the overall depth D is less than the sum of the depth $d_1$ of the rails 204 of the first assembly 202 and the depth $d_2$ of the rails 210 of the second assembly 208 (i.e., $D<d_1+d_2$). In fact, in each of the disclosed embodiments, the overall depth D is approximately equal to the depth $d_1$ of the rails 204 (or 104) of the first assembly 202 (or 104) (i.e., $D\approx d_1$). It is noted, however, that in other embodiments, the assemblies (102, 108, 202 and 208) may be configured such that overall depth D may be approximately equal the depth $d_2$ of the rails 104 (or 204) of the second assembly 102 (or 202). In either case, as already discussed, the overall depth D is less than the sum of the individual depths $d_1$ and $d_2$.

While the invention may be susceptible to various modifications and alternative forms, specific embodiments have been shown by way of example in the drawings and have been described in detail herein. Of course, one or features of one described embodiment may be utilized in conjunction with one or more features of another described embodiment. It should be understood that the invention is not intended to be limited to the particular forms disclosed. Rather, the invention includes all modifications, equivalents, and alternatives falling within the spirit and scope of the invention as defined by the following appended claims.

What is claimed is:

1. A stepladder comprising:

a first assembly including a pair of spaced apart rails defining a first volume, the first assembly including a plurality of rungs coupled between the pair of spaced apart rails;

a second assembly including a pair of spaced apart rails defining a second volume;

a top cap positioned at an uppermost portion of the stepladder when the stepladder is in an orientation of intended use, the top cap having an upper surface and a skirt extending from the upper surface, the skirt including a front side, a back side and a pair of lateral side members;

a first pair of pins, each pin of the first pair coupling an associated one of the pair of rails of the first assembly with the top cap at a first location in an associated one of the lateral side members such that uppermost ends of the pair of rails of the first assembly are positioned adjacent the front side of the top cap;

a second pair of pins, each pin of the second pair pivotally coupling an associated one of the pair of rails of the second assembly with the top cap at a second location in an associated one of the lateral side members such that uppermost ends of the pair of rails of the second assembly are positioned adjacent the back side of the top cap and spaced from the front side of the top cap;

wherein the second assembly is pivotally positionable relative to the first assembly between a first, deployed state and a second, collapsed state, wherein, when in the second, collapsed state, a total volume of the stepladder is less than a sum of the first volume and the second volume; and wherein each of the plurality of rungs maintain their position and orientation relative to the pair of rails of the first assembly when the stepladder is in both the deployed state and collapsed state; each pin of the first pair pivotally couples the associated one of the pair of rails of the first assembly with the top cap; and a pair of hinged spreaders, each hinged spreader being pivotally coupled with the first assembly and being pivotally coupled with the second assembly; and a pair of struts, each strut extending from an associated one of the pair of hinged spreaders towards the top cap and having one end pivotally coupled with the associated one of the pair of hinged spreaders and a second end pivotally coupled with at least one of the second assembly and the top cap, wherein each of the second pair of pins pivotally couples the second end of an associated strut of the pair of struts with the top cap.

2. The stepladder of claim 1, wherein the first assembly is at least partially nested within the second volume defined by the second assembly when the ladder is in the collapsed state.

3. The stepladder of claim 1, wherein the pair of struts extend substantially parallel to the rails of the first assembly when the ladder is in the first, deployed state.

* * * * *